US005102046A

United States Patent [19]

Diana

[11] Patent Number: 5,102,046

[45] Date of Patent: Apr. 7, 1992

[54] COLOR CHANGE SYSTEMS FOR ELECTROSTATIC SPRAY COATING APPARATUS

[75] Inventor: Michael J. Diana, Streamwood, Ill.

[73] Assignee: Binks Manufacturing Company, Franklin Park, Ill.

[21] Appl. No.: 562,453

[22] Filed: Aug. 2, 1990

Related U.S. Application Data

[63] Continuation of Ser. No. 428,456, Oct. 30, 1989, abandoned, which is a continuation of Ser. No. 876,784, Jun. 20, 1986, abandoned.

[51] Int. Cl.[5] ..... B05B 5/025

[52] U.S. Cl. ..... 239/3; 239/112; 239/305; 239/708

[58] Field of Search ..... 239/112, 113, 3, 691, 239/708, 1, 305; 118/302

[56] References Cited

U.S. PATENT DOCUMENTS

| | | | |
|---|---|---|---|
| 3,348,774 | 10/1967 | Wiggins | 239/112 X |
| 3,674,205 | 7/1972 | Kock | 239/112 X |
| 3,933,285 | 1/1976 | Wiggins . | |
| 4,017,029 | 4/1977 | Walberg . | |
| 4,232,055 | 11/1980 | Shaffer . | |
| 4,275,834 | 6/1981 | Spanjersberg et al. | 239/3 |
| 4,313,475 | 2/1982 | Wiggins . | |
| 4,508,266 | 4/1985 | Saito et al. | 239/3 |
| 4,592,305 | 6/1986 | Scharfenberger | 239/112 X |
| 4,771,729 | 9/1988 | Planert et al. | 239/305 X |

FOREIGN PATENT DOCUMENTS

| | | | |
|---|---|---|---|
| 1478853 | 11/1973 | United Kingdom . | |
| 2166982 | 5/1986 | United Kingdom | 239/112 |

*Primary Examiner*—James R. Brittain

*Attorney, Agent, or Firm*—Juettner Pyle & Lloyd

[57] ABSTRACT

Color change systems for electrostatic coating apparatus are characterized by a dielectric manifold in-line between supplies of different colors of coating materials and a material supply line to the apparatus. To initiate a coating operation, a selected color of material is provided through the manifold to fill the supply line, whereafter the manifold is flushed clean of the material. A high electrostatic charging voltage is then applied to the coating apparatus while the material in the line is supplied to the apparatus for being electrostatically charged and emitted by the apparatus to coat an article. For conductive coating materials, during the coating operation the high charging voltage conducted through the material in the hose is blocked by the nonconductive dielectric manifold and cannot reach and charge the material supplies, so there is no need for a protective enclosure around the supplies of leakage of charging current to the supplies. In one embodiment the color change system is manually operable, and in another it is automatically operable.

11 Claims, 4 Drawing Sheets

Fig. 2

| STEP 1 | MV 1 | MV 2 | MV 3 | MV4 | MV5 | MV6 | MV7 | PV 1 | DV1 | FV1 |
|---|---|---|---|---|---|---|---|---|---|---|
| 1 | X | O | O | X | X | X | X | O | O | X |
| 2 | X | X | X | X | X | X | X | X | X | X |
| 3 | O | X | X | O | X | X | X | X | X | O |
| 4 | O | X | X | O | X | O/X | X/O | X | X | O |
| 5 | O | X | X | O | X | X | X | X | X | O |
| 6 | O | X | X | O | O | X | X | X | X | O |
| 7 | O | X | X | O | O | X | X | X | X | O |
| 8 | X | X | X | X | X | X | X | X | X | X |
| 9 | IF SAME COLOR REPEAT STEPS 1-8 | | | | | | | | | |
| 10 | IF DIFFERENT COLOR PERFORM STEPS 11-13 | | | | | | | | | |
| 11 | X | O | O | X | X | X | X | O | O | X |
| 12 | X | O | O | X | X | O/X | X/O | O | O | X |
| 13 | REPEAT STEPS 1-8 | | | | | | | | | |

LEGEND O = OPEN
X = CLOSED
X/O AND O/X=ALTERNATE OPEN AND CLOSED

Fig. 4

| STEP | SV101 | SV102 | SV103 | SV104 | SV105 | SV106 | SV107 | CCV101 | CCV102 | PV101 | PV102 | FV101 | DV101 | DV102 |
|---|---|---|---|---|---|---|---|---|---|---|---|---|---|---|
| 1 | O | O | O | X | X | X | X | X | X | O | O | X | O | O |
| 2 | X | X | X | X | X | X | X | X | X | X | X | X | X | X |
| 3 | X | X | X | O | X | X | X | X | X | X | X | O | X | X |
| 4 | X | X | X | O | X/O | O/X | X | X | X | X | X | O | X | X |
| 5 | X | X | X | O | X | X | O | X | X | X | X | O | X | X |
| 6 | X | X | X | O | X | X | X | O | O | X | X | O | X | X |
| 7 | X | X | X | O | X | X | X | O | O | X | X | O | X | X |
| 8 | X | X | X | X | X | X | X | X | X | X | X | X | X | X |
| 9 | IF SAME COLOR REPEAT STEPS 1-8 | | | | | | | | | | | | | |
| 10 | IF DIFFERENT COLOR PERFORM STEPS 11-13 | | | | | | | | | | | | | |
| 11 | O | O | O | X | X | X | X | X | X | O | O | X | O | O |
| 12 | O | O | O | X | X/O | O/X | X | X | X | O | O | X | O | O |
| 13 | REPEAT STEPS 1-8 | | | | | | | | | | | | | |

LEGEND O = OPEN
X = CLOSED
X/O AND O/X = ALTERNATE OPEN AND CLOSED

COLOR CHANGE SYSTEMS FOR ELECTROSTATIC SPRAY COATING APPARATUS

This is a continuation of copending application Ser. No. 07/428,456 filed on Oct. 30, 1989, abandoned, which in turn was a continuation of Ser. No. 06/876,784, filed on June 20, 1986, abandoned.

BACKGROUND OF THE INVENTION

The present invention relates to color change systems for spray coating apparatus, and in particular to improved color change systems for supplying conductive coating materials to electrostatic spray coating apparatus.

Color change systems for spray coating apparatus have application in industrial operations where articles are to be spray coated at a station or as they move along a production line. Where the articles are to be coated a wide variety of colors, it generally is not practical to establish separate spray stations or production lines for each color, or even to spray a long sequence of articles of one color, then another long sequence of articles of a second color, etc. Instead, it is desirable to be able to make color changes rapidly and simply at a single station.

Electrostatic spray coating devices have increased painting efficiency over nonelectrostatic types. In order to charge the paint in an electrostatic spray coating system, it is necessary to have some means of applying the charge to the paint. In some systems, charging is accomplished by an electrode, connected to a high voltage power supply and placed in close proximity to or in contact with the fluid either just prior to or very close to the point of atomization. In rotary atomization systems, the rotary atomizer is ordinarily of a conductive material and connected to the power supply, such that the atomizer itself is the electrode. Whichever type of system is used, the charging potential is usually on the order of several tens of kilovolts, and the electrostatic charging process works well when spraying nonconductive paints. However, when spraying paints which are moderately conductive, precautions must be taken to prevent the high voltage at the electrode from being short circuited to ground through the column of paint.

One prior approach was to isolate the entire paint supply and color change system from ground potential. This allowed the entire paint system to "float" at the charging potential, but had the drawback that a large amount of electrical energy was capacitively stored in the system. To prevent the capacitively stored energy from presenting a shock hazard to operating personnel, it was necessary to provide a protective enclosure around the paint system, which increased the cost of the system and required that the spraying operation be shut down and the system electrically discharged whenever necessary to replenish the supplies of paint. Also, during operation of the system, the capacitively stored energy gave rise to the possibility of a spark causing an explosion in an environment such as exists when solvent based paints are being sprayed.

Another approach was to ground the paint supplies and color changer, and to connect the spraying apparatus to the paint system through a hose that was long enough that the electrical resistance of the paint in the hose, between the high voltage at the spraying apparatus and paint system, was large enough to reduce electrical current leakage through the hose to the paint supplies to a level that did not short out the electrode or cause the charging voltage to fall to an unacceptably low level. A disadvantage of this approach was that the hose, due to its extended length, was not only very bulky and hard to manage, but it was also difficult to thoroughly flush it clean of one color of paint in preparation for spraying another color. In addition, although the extended length of the hose limited the magnitude of leakage current, leakage current nonetheless occurred and represented "wasted" charging energy.

OBJECT OF THE INVENTION

The primary object of the present invention is to provide improved color change systems for electrostatic spray coating apparatus, which electrically isolate supplies of different colors of coating materials from the electrostatic charging voltage at the apparatus, without electrical grounding of the supplies, so that even when the coating materials are conductive, there is no leakage of charging current to the supplies or need to provide a protective enclosure around the supplies.

SUMMARY OF THE INVENTION

The present invention provides a system for supplying selected colors of fluidic coating materials to high voltage electrostatic coating apparatus. The system comprises a color changer having a plurality of inlets for connection with individual ones of a plurality of supplies of different colors of coating material, and an outlet, as well as a material supply line that is connectable at one end with a material inlet to the coating apparatus. Also included is coupling means in-line between the color changer outlet and an opposite end of the supply line for connecting the outlet and line for flow of a selected color of coating material from the outlet into the line to fill the line with coating material, along with means connected with the line at a point proximate to its opposite end for forcing the material therein, after the line is full of the material, to the coating apparatus for electrostatic charging and discharge of the material by the apparatus. The coupling means electrically isolates the supply line and coating material therein from the color changer outlet during electrostatic charging and discharge of the material by the coating apparatus, so that the high voltage at the coating apparatus is not electrically coupled to the color changer and supplies of coating material.

The invention also contemplates a method of supplying selected colors of fluidic coating materials, to high voltage electrostatic spray coating apparatus, with a color changer having a plurality of inlets for connection with individual ones of a plurality of supplies of different colors of coating materials and an outlet for the materials. The method comprises the steps of coupling a first end of a material supply line to the color changer outlet and a second end to a material inlet to the coating apparatus, operating the color changer to flow a selected color of material into the supply line to fill the line with the material, forcing the material in the line to the coating apparatus for electrostatic charging and discharge of the material by the apparatus, and electrically isolating the first end of the line from the color changer outlet during the forcing step, so that the high voltage at the coating apparatus is not electrically coupled through the material in the line to the color changer outlet and the supplies of coating material.

BRIEF DESCRIPTION OF THE DRAWINGS

FIG. 2 is a truth table showing a mode of operation of the system of FIG. 1;

FIG. 4 is a truth table showing a mode of operation of the system of FIG. 3.

DETAILED DESCRIPTION

Figure 1:
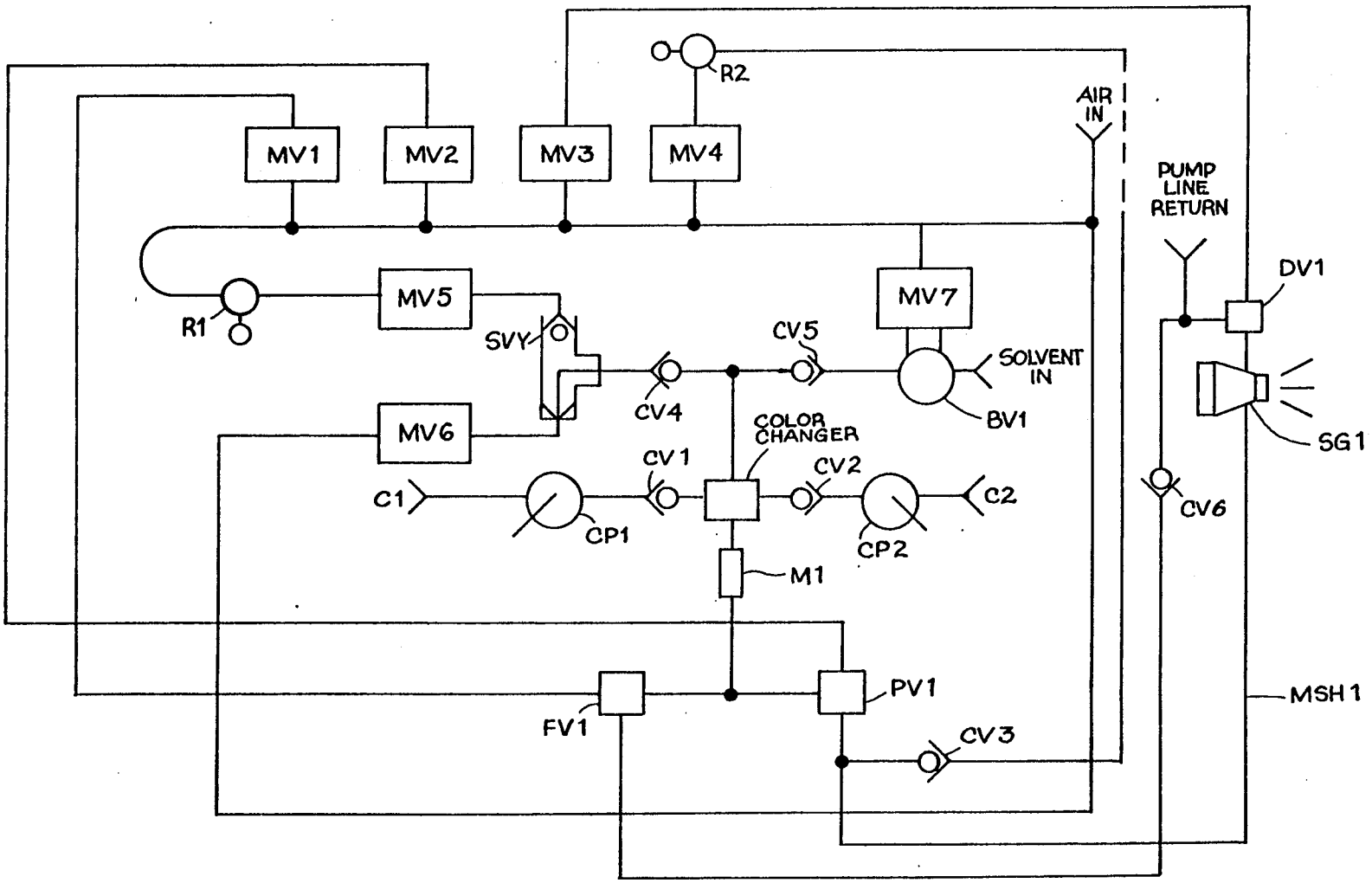
FIG. 1 is a schematic representation of a manually operable color change system for electrostatic spray coating apparatus, in accordance with one embodiment of the invention.

FIG. 1 schematically shows a high voltage electrostatic coating apparatus or spray gun SG1 adapted to be supplied with and to spray any one of a plurality of materials or fluids. Also schematically shown, in accordance with one embodiment of the invention, is a manually operable color change system for selectively supplying any one of a number of different colors of paints or coating materials Cn to the gun, of which C1 and C2 represent two of a large number of different colors of materials. Although the materials may be electrically nonconductive, the color change system is uniquely adapted to supply conductive coating materials to the spray gun, while maintaining electrical isolation of the system from the high voltage at the gun. Specifically, the structure and mode of operation of the system blocks the high voltage at the gun from being coupled to the system through a column of material extending between the gun and system.

The color change system includes pluralities of manually operable pilot valves MV1-MV7 and check valves CV1-CV6. Inlets to the pilot valves are connected to a source of air under pressure, such as shop air, with the inlet to the valve MV5 being connected to the air source through a pressure regulator R1. Outlets from the valves MV1-MV3 respectively connect to control inputs to pneumatically controlled valves comprising a flush valve FV1, a paint valve PV1 and a dump valve DV1, to open and close paths through the flush, paint, and dump valves. Outlets from the valves MV5 and MV6 are applied to inlets to a shuttle valve SV1, the outlet from which is coupled through the check valve CV4 to an inlet to a conventional color changer. The valve MV7 has a pair of outlets connected to control inputs to a pneumatically controlled ball valve BV1, the inlet to which connects to a source of liquid solvent under pressure and the outlet from which is coupled through the check valve CV5 to the color changer inlet.

The color changer has a plurality of additional inlets, each for connection with an individual one of a plurality of supplies or sources of different colors of coating material, of which only sources C1 and C2 are shown. Each source connects to its respective color changer inlet through an associated check valve, for example the check valve CV1 for the source C1 and the check valve CV2 for the source C2. The sources may be pressurized to cause material to flow to the color changer or, as shown, color pumps CP1 and CP2 may be used to move material from the sources to the color changer. The outlet from the color changer connects through an elongate manifold M1, of dielectric or electrically insulating material, to inlets to the flush valve FV1 and paint valve PV1. The outlet from the flush valve connects through a check valve CV6 to a dump or return line, and the outlet from the paint valve connects through a material supply hose MSH1 to a paint inlet passage in the spray gun SG1. The paint inlet passage, in addition to being connectable to a spray head of the gun through a valve (not shown) internal of the gun, extends through the gun to an inlet to the dump valve DV1, the outlet from which connects to the dump or return line. To move paint through the material supply hose between the paint valve and spray gun for being emitted from the gun, the outlet from the valve MV4 couples through a pressure regulator R2 and a check valve CV3 to the hose at a point proximate to the paint valve outlet.

Considering operation of the color change system, and with reference also to the truth table of FIG. 2, to initiate a spraying operation with the system in an initially "clean" condition and the spray gun SG1 off, in a step 1 the pilot valves MV2 and MV3 are manually opened to open the paint valve PV1 and dump valve DV1, whereupon a selected color of paint is provided by the color changer to and through the manifold M1, paint valve and material supply hose MSH1 to fill the hose between the paint valve and spray gun. Based upon the inside diameter of the hose, it is selected to have a length such that, when full, it contains a predetermined quantity of paint sufficient for a single spraying operation or a plurality of operations, and to that end the paint advantageously is provided from the supply thereof and through the color changer at a rate and for a time that are selected to fill the hose without significant loss of paint through the gun to the dump valve. After the selected time, in a step 2 the valves MV2 and MV3 are closed to close the paint and dump valves.

With the material supply hose MSH1 full of paint between the paint valve PV1 and spray gun SG1, and prior to application of the high voltage to and opening the internal material valve of the gun, in a step 3 the valve MV1 is opened to open the flush valve FV1 and the valve MV4 is opened to apply air under pressure, through the regulator R2 and check valve CV3, to the paint in the hose at the point proximate to the outlet from the closed paint valve. In a step 4, the color changer and manifold M1 are then flushed clean of paint by opening and closing the valve MV6 to apply bursts of high pressure air through the shuttle valve SV1 and check valve CV4, and by opening and closing the valve MV7 to apply bursts of solvent through the check valve CV5, to and through the color changer, manifold, flush valve and check valve CV6 to the dump line. The valves MV6 and MV7 are alternately operated, thereby to apply alternate bursts of air and solvent through the color changer and manifold. After the color changer and manifold are clean, the valves MV6 and MV7 are closed in a step 5 and then, in a step 6, the valve MV5 is opened to apply a flow of low pressure air, as determined by the setting of the regulator R1, through the color changer, manifold, flush valve and check valve CV6 to the dump line. At this point, the system is prepared to electrostatically spray coat one or more articles, and during a step 7, while the valves MV1, MV4 and MV5 remain open, a high voltage is applied to an electrode of the gun and the internal material valve of the gun is opened, so that the air under pressure from the valve MV4 forces the paint in the hose to the spray gun for being emitted therefrom in an electrostatically charged atomized spray.

During the spray coating operation, the high voltage at the electrode is coupled to the paint at the spray gun, and if the paint is conductive, the voltage is carried back through the paint in the material supply hose MSH1 to the paint valve PV1, which valve preferably is of a dielectric or electrically insulating material, so that it does not present a shock hazard to an operator of the system. From the paint valve, high voltage is carried toward the manifold M1, but it is not conducted through the manifold to the color changer and paint supplies, since the manifold is of a dielectric or electrically insulating material, and at this time (during application of the high voltage to the spray gun) its interior passage is free of paint and has a low pressure flow of air therethrough, via the valve MV5, which maintains the passage dry and nonconductive. Consequently, the manifold effectively blocks the high voltage from being coupled to the color changer and paint supplies, so there is no capacitive storage of energy by or leakage of charging current to the same, and therefore no need to provide a protective enclosure around the same.

At the end of the coating operation, in a step 8 the valves MV1, MV4 and MV5 are closed to close the flush valve FV1, interrupt application of air under pressure to the material supply hose MSH1 and interrupt the flow of low pressure air through the manifold M1. If during the next coating operation the same color of paint is to be sprayed, according to a step 9, the preceding steps 1–8 are repeated. On the other hand, if a different color of paint is to be sprayed, then according to a step 10, additional steps 11–13 are performed. In particular, in the step 11, the valves MV2 and MV3 are opened to open the paint valve PV1 and dump valve DV1. Then, in a step 12 the valves MV6 and MV7 are alternately operated in an out of phase relationship, to apply alternate bursts of air and solvent through the color changer, manifold, paint valve, material supply hose, spray gun SG1 and dump valve to clean the paint valve, hose and spray gun of the previous color of paint in preparation for receiving the next color. After the paint valve, hose and spray gun are clean, according to a step 13, the steps 1–8 are repeated with the new color of paint.

Figure 3:
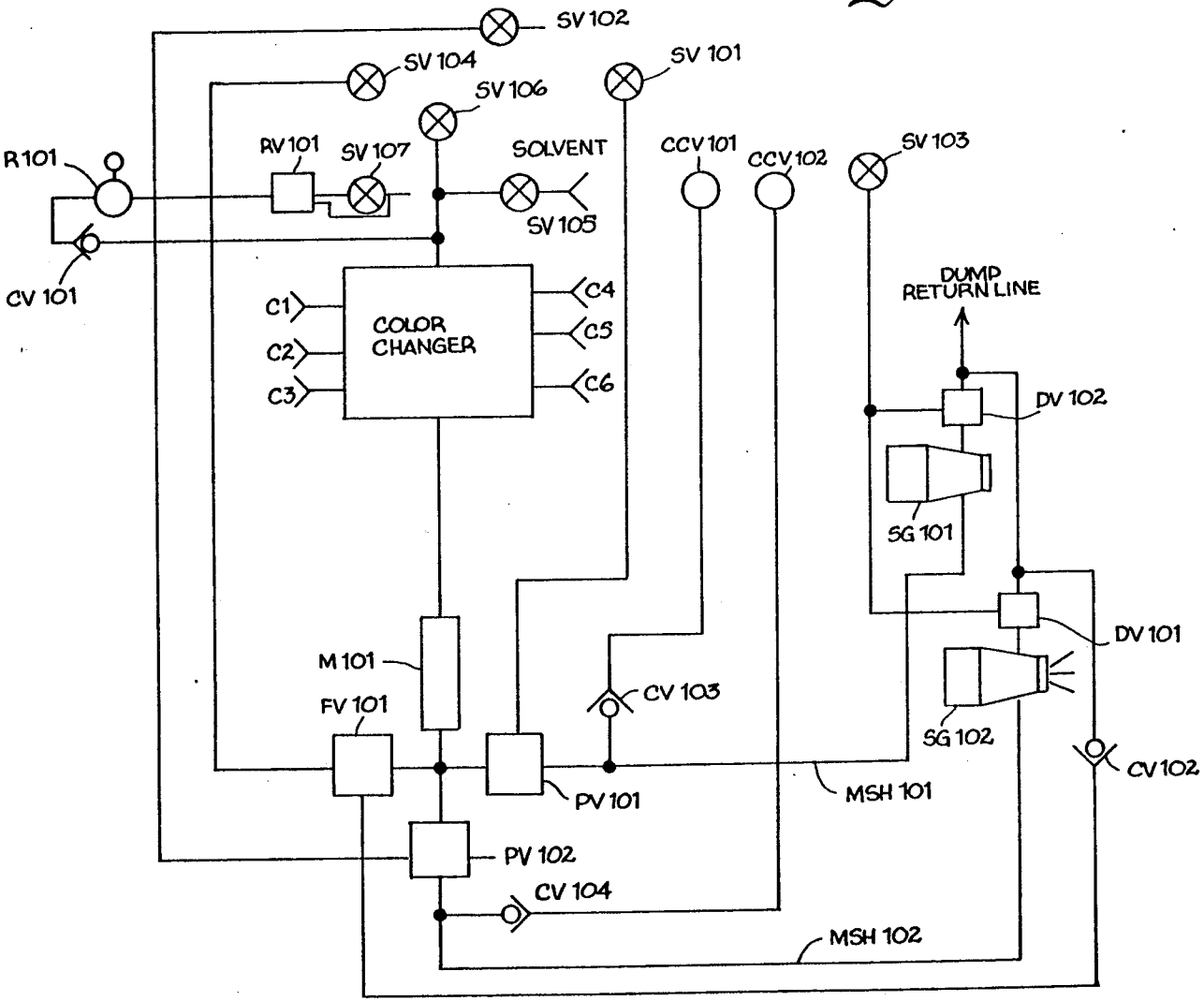
FIG. 3 is a schematic representation of an automatic color change system for electrostatic spray coating apparatus, in accordance with another embodiment of the invention.

FIG. 3 illustrates an automatically controlled embodiment of color change system for selectively supplying any one of a number of different colors of paints or coating materials to a pair of high voltage electrostatic spray guns SG101 and SG102, of which C1–C6 are representative of six of a large number of different colors of paints that can be delivered. Although the paints may be electrically nonconductive, as for the system of FIG. 1, this color change system also is uniquely adapted to supply conductive coating materials to the spray guns, while maintaining electrical isolation of the system and material supplies from the high voltage at the guns.

The color change system of FIG. 3 includes solenoid valves SV101–SV104, SV106 and SV107, inlets (not shown) to which connect to a source of air under pressure, along with a solenoid valve SV105, the inlet to which connects with a supply of solvent under pressure. Outlets from the valves SV101–SV104 are respectively connected to control inputs to pneumatically controlled paint valves PV101 and PV102, dump valves DV101 and DV102, and a flush valve FV101, to open and close paths through the paint, dump and flush valves. Outlets from the valves SV105 and SV106 are applied directly to an inlet to a color changer, while an outlet from the valve SV107 is applied to the color changer inlet through a Ross valve RV101, regulator R101 and check valve CV101.

The color changer has a plurality of additional inlets for connecting with individual ones of a plurality of sources of different colors of paint, of which sources C1–C6 are shown. The outlet from the color changer connects through an elongate manifold M101 of dielectric or insulating material, to inlets to the paint and flush valves PV101, PV102 and FV101, the outlet from the flush valve connects through a check valve CV102 to a dump or return line, and the outlets from the paint valves connect through respective material supply hoses MSH101 and MSH102 to paint inlet passages in the spray guns SG101 and SG102. The paint inlet passages, in addition to connecting to spray heads of the guns through internal material flow valves (not shown), also connect to inlets to respective dump valves DV101 and DV102, outlets from which connect to the dump return line. To move paint through the material supply hoses to the spray guns, computer controlled valves CCV101 and CCV102 have inlets (not shown) connected with the air supply and outlets coupled through respective check valves CV103 and CV104 to the material supply hoses MSH101 and MSH102 at points proximate the paint valve outlets. As for the system of FIG. 1, each material supply hose has a length, based upon its inside diameter, such that when full of paint it contains a predetermined quantity of paint sufficient for one or more spraying operations.

The color change system of FIG. 3 is adapted for automatic control, for example by a microprocessor that is programmable to cause performance of desired functions. In a preferred operation of the system, and with reference also to the truth table of FIG. 4 and starting with an initially "clean" system, in a step 1 the solenoid valves SV101–SV103 are opened to open paths through the paint valves PV101 and PV102 and the dump valves DV101 and DV102, and a selected color of paint is supplied through the color changer, manifold M101, paint valves, material supply hoses MSH101 and MSH102, spray guns SG101 and SG102 and dump valves to the return line to fill the hoses with paint. The solenoid valves SV101–SV103 are then closed in a step 2 to close the paint and dump valves, and in a step 3 the solenoid valve SV104 is opened to establish a path through the flush valve. The color changer and manifold are then cleaned in a step 4, during which the solenoid valves SV105 and SV106 are alternately operated, such that when the valve SV105 is open the valve SV106 is closed, and vice versa, to apply alternate bursts of high pressure air and solvent through the color changer and manifold and thence through the flush valve and check valve CV102 to the return dump line to clean the color changer and manifold of paint.

After the manifold M101 and color changer are clean, in a step 5 the valves SV105 and SV106 are closed and the valve SV107 is opened to flow air at a reduced pressure, as determined by the regulator R101, through the check valve CV101, color changer and manifold, and thence through the flush valve and check valve CV102 to the return line. Next, a high electrostatic charging voltage is applied to the spray guns SG101 and SG102, and in a step 6 the valves CCV101 and CCV102 are operated to apply air at a selected pressure to the material supply hoses MSH101 and MSH102 at the points proximate the outlets from the paint valves PV101 and PV102, thereby to force paint in the hoses to the spray guns for being emitted in an electrostatically charged, atomized spray.

Spray coating occurs during step 7. At this time, the high electrostatic charging voltage at the spray guns is coupled to and through the paint in the hoses MSH101 and MSH102 to the paint valves PV101 and PV102, which valves advantageously are of an electrically insulating material to protect an operator against a shock hazard. From the paint valve, the voltage is conducted toward the manifold M101, but it is not carried through the manifold to the color changer and paint supplies, since the manifold is of a dielectric material, its passage has been cleaned of paint, and there is an air flow through the passage that keeps it dry and nonconductive. Thus, as in the embodiment of FIG. 1, there is no leakage of charging current to the paint supplies or need to provide a protective enclosure around the supplies.

At the end of the spraying operation, the high voltage is removed from the spray guns and, in a step 8, the valves SV104, CCV102 are closed. If the same color of paint is to be sprayed again, then according to a step 9, steps 1–8 are repeated. On the other hand, if a different color of paint is to be sprayed, then pursuant to a step 10, the system is first cleaned of the previously supplied color of paint.

Specifically, if a new color of paint is to be sprayed, in a step 11 the solenoid valves SV101–SV103 are opened to open the paint valves PV101 and PV102 and the dump valves DV101 and DV102. Next, during a step 12 the solenoid valves SV105 and SV106 are alternately opened to provide alternate applications of solvent and high pressure air through the paint valves, material supply hoses MSH101 and MSH102, spray guns and dump valves to the dump return line to clean the same. Steps 1–8 are than repeated.

The invention thus provides improved embodiments of color change systems for electrostatic spray coating apparatus, which effectively isolate the system and supplies of coating material from the high electrostatic charging voltage, even when the material is conductive. Consequently, there is no leakage of electrostatic charging current to the system and supplies, and therefore no need for a protective enclosure around the same.

While embodiments of the invention have been described in detail, various modifications and other embodiments thereof may be devised by one skilled in the art, without departing from the spirit and scope of the invention, as defined in the appended claims.

What is claimed is:

1. A method of supplying selected colors of electrically conductive coating materials to high voltage electrostatic coating apparatus with a color changer having inlets for connection with supplies of different colors of coating materials, a solvent and air and an outlet for the coating materials, solvent and air, wherein the color changer and the supplies of coating materials and solvent are at ground potential, comprising the steps of:

a) connecting to the outlet of the color changer a dielectric conduit that is effective, when clean and dry, to electrically isolate the color changer and supplies of coating materials and solvent from the high voltage of the coating apparatus;

b) connecting a coating material reservoir to the conduit;

c) supplying the coating materials, solvent and air to respective color changer inlets under positive pressure;

d) operating the color changer to cause delivery under positive pressure through the conduit to the reservoir of a predetermined quantity of a selected color of coating material adequate to perform a selected coating operation;

e) venting the reservoir during delivery of the selected color of coating material thereto to facilitate rapid filing of the reservoir with the predetermined quantity of coating material;

f) upon completion of delivery of the selected color of coating material to the reservoir, terminating said venting step and interrupting the coating material flow path from the conduit to the reservoir;

g) operating the color changer to first deliver bursts of solvent and air under positive pressure through the color changer and the conduit to a valve controlled dump to clean the color changer and the conduit, and to then deliver air under positive pressure to the conduit to dry the same, thereby to render the conduit nonconducting and to establish thereby a voltage block electrically isolating the color changer and the supplies of coating materials and solvent from the reservoir, the coating material in the reservoir and the coating apparatus;

h) coupling the reservoir to the coating apparatus and introducing air under pressure into the reservoir to force the predetermined quantity of coating material in the reservoir to the coating apparatus;

i) energizing the coating apparatus at high voltage and operating the coating apparatus to perform the selected spray coating operation and spray coat with the predetermined quantity of coating material one or more workpieces;

j) discontinuing said energizing step upon completion of the selected spray coating operation; and k) establishing the coating material flow path from the conduit to the reservoir.

2. A method as in claim 1, wherein the reservoir comprises a tubular conduit having an inside diameter and a length such that, when filled, the tubular conduit contains a predetermined quantity of coating material adequate to perform the selected coating operation.

3. A method of supplying selected colors of electrically conductive coating materials to high voltage electrostatic coating apparatus with a color changer having inlets for connection with supplies of different colors of coating materials, a solvent and air and an outlet for the coating materials, solvent and air, comprising the steps of:

a) maintaining the color changer and the supplies of coating materials and solvent at ground potential;

b) connecting to the outlet of the color changer one end of a dielectric conduit that is effective, when clean and dry, to electrically isolate the grounded color changer and supplies of coating materials and solvent from the high voltage of the coating apparatus;

c) connecting a coating material reservoir to an opposite end of the conduit remote from the color changer;

d) supplying the coating materials, solvent and air to respective color changer inlets under positive pressure;

e) operating the color changer to cause delivery under positive pressure through the conduit to the reservoir of a predetermined quantity of a selected color of coating material adequate to perform a selected coating operation;

f) upon completion of delivery of the selected color of coating material to the reservoir, interrupting the coating material flow path from the conduit to the reservoir;

g) operating the color changer to first deliver bursts of solvent and air under pressure through the color changer and the conduit to a valve controlled dump to clean the color changer and the conduit and to then deliver air under positive pressure to the conduit to dry the same, thereby to render said conduit nonconducting and to establish thereby a voltage block electrically isolating the color changer and the supplies of coating materials and solvent from the reservoir, the coating material in the reservoir and the coating apparatus;

h) coupling the reservoir to the coating apparatus;

i) connecting a supply of air under pressure to the reservoir via an air valve;

j) opening the air valve and introducing air under pressure into the reservoir to force the predetermined quantity of coating material in the reservoir to the coating apparatus to perform the selected coating operation;

k) energizing the coating apparatus at high voltage and operating the coating apparatus to perform the selected spray coating operation and spray coat with said predetermined quantity of coating material one or more workpieces;

l) deenergizing the coating apparatus;

m) closing the air valve;

n) establishing the coating material flow path from the conduit to the reservoir;

o) operating the color changer to deliver bursts of solvent and air through the color changer, the conduit, the reservoir and the coating apparatus to the valve controlled dump to clean the reservoir and coating apparatus; and q) repeating the foregoing steps.

4. A method as in claim 3, including the steps of venting the reservoir during delivery of the selected color of coating material thereto to facilitate rapid filling of the reservoir with the predetermined quantity of coating material; and terminating said venting step upon completion of delivery of the selected color of coating material to the reservoir.

5. A method as set forth as in claim 3, wherein the reservoir comprises a tubular conduit having an inside diameter and a length such that, when filled, the tubular conduit contains a predetermined quantity of coating material adequate to perform the selected coating operation.

6. A method of supplying selected colors of electrically conductive coating materials to high voltage electrostatic coating apparatus with a color changer having inlets for connection with supplies of different colors of coating materials, a solvent and air and an outlet for the coating materials, solvent and air, comprising the steps of:

a) supplying the coating materials, solvent and air to respective color changer inlets under positive pressue;

b) maintaining the color changer and the supplies of coating materials and solvent at ground potential;

c) connecting to the outlet of the color changer one end of a dielectric conduit that is effective, when clean and dry, to electrically isolate the grounded color changer and supplies of coating materials and solvent from the high voltage of the coating apparatus;

d) connecting an inlet to a coating material reservoir to an opposite end of the conduit remote from the color changer through a first valve at the reservoir inlet;

e) opening the first valve and effecting delivery under positive pressure, from the color changer, through the conduit and the first valve and into the reservoir, of a predetermined quantity of a selected color of coating material adequate to perform a selected coating operation;

f) closing the first valve to close the inlet to the reservoir;

g) cleaning the color changer with solvent and air;

h) delivering solvent under positive pressure through the conduit to a valve controlled dump to clean the conduit, and then delivering air under positive pressure to the conduit to dry the conduit, thereby to render the conduit nonconducting and to establish thereby a voltage block electrically isolating the color changer and the supplies of coating materials and solvent from the reservoir, the coating material in the reservoir and the coating apparatus;

i) coupling the reservoir to the coating apparatus;

j) connecting a supply of air under pressure to the reservoir via a second valve;

k) opening the second valve and introducing air under pressure into the reservoir to force the predetermined quantity of coating material in the reservoir to the coating apparatus to perform the selected coating operation;

l) energizing the coating apparatus at high voltage and operating the coating apparatus to perform the selected spray coating operation and spray coat with the predetermined quantity of coating material one or more workpieces;

m) deenergizing the coating apparatus;

n) closing the second valve;

o) delivering solvent and air under pressure through the reservoir and the coating apparatus to the valve controlled dump to clean the reservoir and the coating apparatus in preparation for the next succeeding coating operation.

7. A method as in claim 6, including the step of venting the reservoir during delivery of the selected color of coating material thereto to facilitate rapid filling of the reservoir with the predetermined quantity of coating material.

8. A method as set forth in claim 6, wherein the reservoir has an outlet connected to the coating apparatus, and air is supplied via the second valve to the reservoir substantially immediately downstream from the first valve.

9. A method as set forth in claim 6, including the step of repeating steps a) through n) for each selected color of coating material to be used for a coating operation.

10. A method as in claim 1, including repeating the foregoing steps with the selected color of coating material.

11. A method as in claim 1, including the steps, following step k), of operating the color changer to deliver bursts of solvent and air through the color changer, the conduit, the reservoir and the coating apparatus to the valve controlled dump to clean the reservoir and coating apparatus, and then repeating the foregoing steps with a second selected color of coating material.

* * * * *